US006990953B2

(12) United States Patent
Nakahara et al.

(10) Patent No.: US 6,990,953 B2
(45) Date of Patent: Jan. 31, 2006

(54) IDLE ROTATION CONTROL OF AN INTERNAL COMBUSTION ENGINE

(75) Inventors: Yoichiro Nakahara, Inagi (JP); Shigeyuki Sakaguchi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/114,186

(22) Filed: Apr. 26, 2005

(65) Prior Publication Data

US 2005/0257770 A1 Nov. 24, 2005

(30) Foreign Application Priority Data

May 24, 2004 (JP) ..... 2004-153012

(51) Int. Cl.
*F02D 41/08* (2006.01)

(52) U.S. Cl. ..... 123/339.19; 123/339.16

(58) Field of Classification Search ..... 123/339.16, 123/339.17, 339.18, 339.19, 339.2, 339.21
See application file for complete search history.

(56) References Cited

U.S. PATENT DOCUMENTS 5,121,725 A * 6/1992 Araki ..... 123/339.17
5,415,143 A * 5/1995 Togai ..... 123/339.17
5,701,867 A * 12/1997 Mizutani et al. ..... 123/339.16
5,996,552 A * 12/1999 Iijima et al. ..... 123/339.18
6,109,236 A * 8/2000 Takahashi et al. ..... 123/339.19
2004/0221833 A1 * 11/2004 Shepperson ..... 123/339.16

FOREIGN PATENT DOCUMENTS

JP 09-068084 A 3/1997

* cited by examiner

*Primary Examiner*—Erick Solis
(74) *Attorney, Agent, or Firm*—Foley & Lardner LLP

(57) ABSTRACT

A controller 21 controls an intake air flow rate via an electronic throttle 14 based on a feedback correction amount set so that a rotation speed (NE) of an internal combustion engine (11) during idle running gradually approaches a target value (tNE). When the deviation (ΔNE) between the rotation speed (NE) and the target value (tNE) becomes equal to or greater than a predetermined value (XNE), increase correction of the intake air flow rate is performed according to the deviation (ΔNE). When the deviation (ΔNE) falls below the predetermined value (XNE), a value corresponding to the increase correction amount at that time is added to the feedback correction amount, and subsequent increase correction amounts are set to zero, so the decreased engine rotation speed (NE) can be returned to the target value (tNE) with a rapid response, and future drops of the returned engine rotation speed (NE) are prevented.

11 Claims, 6 Drawing Sheets

13 THROTTLE ACTUATOR
15 THROTTLE POSITION SENSOR
16 AIR FLOW METER
18 ACCELERATOR PEDAL SWITCH

NE DEFICIT SECTION

NE
tNE

ΔNE $Q_{TOTAL}$ $\Delta QN_{MAX}$ $\Delta QN_{MAX}$
$Q_{FB}$
P
R
Q

NE DEFICIT SECTION
tNE
NE

XNE
ΔNE $Q_{TOTAL}$ $\Delta QN_{MAX}$ $\Delta QN_{MAX}$
$Q_{FB}$
P
R
Q

IDLE ROTATION CONTROL OF AN INTERNAL COMBUSTION ENGINE

FIELD OF THE INVENTION

This invention relates to idle rotation speed control of an internal combustion engine.

BACKGROUND OF THE INVENTION

Tokkai Hei 9-68084 published by the Japan Patent Office in 1997 proposes a vehicle internal combustion engine wherein the intake air flow rate is open-loop corrected for predictable loads such as electrical accessories and the air conditioner, and the intake air flow rate is feedback corrected based on the real rotation speed such that a target idle rotation speed is maintained, for loads which cannot be predicted, such as due to external disturbances.

SUMMARY OF THE INVENTION

As a general characteristic of proportional/integral control in feedback correction, if the feedback gain is too large, hunting or overshoot occur, and if the feedback gain is too small, convergence to the target value is slow. In an internal combustion engine for vehicles, the idle rotation speed does not vary suddenly, so a smaller gain setting which emphasizes control stability is usually used. As a result, when a large load which cannot be predicted acts and the idle rotation speed falls by a large amount, convergence to the target value of the idle rotation speed tends to be delayed.

Examples of loads which are difficult to predict are when release of the lockup clutch of an automatic transmission is too late due to sudden braking, or when a large load acts because load changes cannot be detected due to a fault of the power steering switch or oil pressure switch.

It is therefore an object of this invention to rapidly return the idle rotation speed to the target value with good response under stable control when the idle rotation speed falls sharply due to a large load fluctuation.

In order to achieve the above object, this invention provides an idle rotation speed control device of an internal combustion engine. The control device comprises a mechanism which regulates an intake air flow rate of the internal combustion engine, a sensor which detects an engine rotation speed of the internal combustion engine, and a programmable controller which controls the intake air flow rate regulating mechanism.

The controller is programmed to calculate, when the engine rotation speed is different from an target idle engine rotation speed, a feedback correction amount so that the intake air flow rate is gradually varied in a direction such that the engine rotation speed approaches the target idle engine rotation speed, calculate an increase correction amount of the intake air flow rate based on the engine rotation speed, control, when the engine rotation speed drops below the target idle rotation speed, the mechanism based on the sum of the feedback correction amount and increase correction amount, determine whether or not the engine rotation speed satisfies a preset increase correction termination condition, and set, when the engine rotation speed satisfies the increase correction termination condition, the sum of the feedback correction amount and increase correction amount when the termination condition is satisfied, to a new feedback correction amount, while setting the increase correction amount for subsequent control to be zero.

This invention also provides an idle rotation speed control method of the internal combustion engine, The control method comprises detecting an engine rotation speed of the internal combustion engine, calculating, when the engine rotation speed is different from an target idle engine rotation speed, a feedback correction amount so that the intake air flow rate is gradually varied in a direction such that the engine rotation speed approaches the target idle engine rotation speed, calculating an increase correction amount of the intake air flow rate based on the engine rotation speed, controlling, when the engine rotation speed drops below the target idle rotation speed, the mechanism based on the sum of the feedback correction amount and increase correction amount, determining whether or not the engine rotation speed satisfies a preset increase correction termination condition, and setting, when the engine rotation speed satisfies the increase correction termination condition, the sum of the feedback correction amount and increase correction amount when the termination condition is satisfied, to a new feedback correction amount, while setting the increase correction amount for subsequent control to be zero.

The details as well as other features and advantages of this invention are set forth in the remainder of the specification and are shown in the accompanying drawings.

DESCRIPTION OF THE PREFERRED EMBODIMENTS

Figure 1:
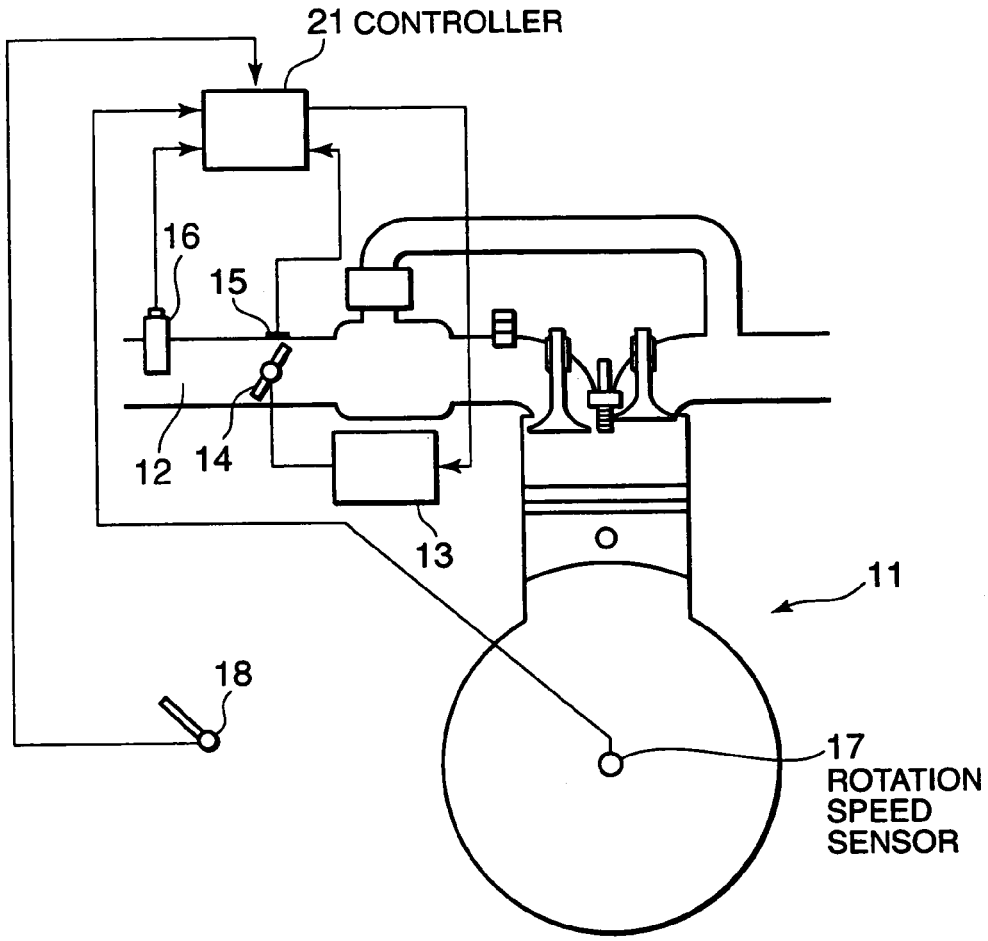
FIG. 1 is a schematic diagram of an idle rotation control device according to this invention.

Referring to FIG. 1 of the drawings, an internal combustion engine 11 comprises an electronic throttle 14 which regulates an intake air flow rate supplied to an intake passage 12. The electronic throttle 14 is operated by a throttle actuator 13 which responds to an incoming signal from a controller 21.

The controller 21 performs feedback control of the idle rotation speed to a target rotation speed through a signal output to the throttle actuator 13 based on incoming signals from various sensors during idle rotation of the internal combustion engine 11.

The controller 21 comprises a microcomputer comprising a central processing unit (CPU), read-only memory (ROM), random access memory (RAM), and an input/output interface (I/O interface). The controller 21 may also comprise plural microcomputers.

The various sensors include a throttle position sensor 15 which detects an opening of the electronic throttle 14, an air flow meter 16 which detects an intake air flow rate of the intake passage 12, an engine rotation speed sensor 17 which detects a rotation speed NE of the internal combustion engine 11, and an accelerator pedal switch 18 which detects whether or not the accelerator pedal of the vehicle is in a release state.

The controller 21 determines whether or not the internal combustion engine 11 is in an idle running state based on a signal from the accelerator pedal switch 18. In the idle running state, the idle rotation speed is feedback-controlled to a predetermined target idle rotation speed according to a signal from the rotation speed sensor 17, by regulating the intake air flow rate via the throttle actuator 13 and electronic throttle 14. In this process, feedback control of the intake air flow rate is also performed based on a signal from the air flow meter 16.

The basic feedback control of the idle rotation speed is integral control. Further, according to this invention, if a rotation speed deviation is large, the intake air flow rate is corrected irrespective of the feedback control amount so as to recover the engine rotation speed to the target idle rotation speed.

Next, referring to FIG. 2, the intake air flow rate correction routine performed by the controller 21 will be described. The controller 21 performs this routine at an interval of ten milliseconds during running of the internal combustion engine 11. When the internal combustion engine 11 is in an idle running state, as described above, feedback control to the target idle rotation speed of an engine rotation speed is performed by another idle rotation speed feedback control routine.

The routine shown in this figure corrects the target intake air flow rate under predetermined conditions. It has priority over control of the opening of the electronic throttle 14 which is performed as part of the idle rotation speed feedback control routine, and controls the opening of the electronic throttle 14 based on a corrected target intake air flow rate.

First, in a step S201, the controller 21 determines whether or not the internal combustion engine 11 is in an idle running state. Specifically, it is determined that the internal combustion engine 11 is in the idle running state when the accelerator pedal is released based on the signal from accelerator pedal switch 18.

When the determination of the step S201 is negative, the controller 21 terminates the routine immediately without performing subsequent steps. When the determination of the step S201 is affirmative, the controller 21 performs the processing of a step S202 and subsequent steps. In the step S202, the controller 21 calculates a rotation speed deviation ΔNE of the internal combustion engine 11 by the following equation (1):

$$\Delta NE = tNE - NE \tag{1}$$

where, tNE=target idle rotation speed, and

NE=real rotation speed of the internal combustion engine 11.

The real rotation speed NE is the detection speed of the rotation speed sensor 17. As shown by the equation, when the real rotation speed of the internal combustion engine 11 is less than the target idle rotation speed, the rotation speed rotation speed deviation ΔNE is a positive value.

The controller 21 further calculates a feedback correction amount $Q_{FB}$ of the intake air flow rate in basic feedback control by the following equation (2):

$$\text{for } \Delta NE > Y, Q_{FB} = Q_{FBZ} + \Delta l, \text{ and}$$

$$\text{for } \Delta NE < Y, Q_{FB} = Q_{FBZ} - \Delta l \tag{2}$$

where, Y=boundary value which specifies a dead zone, $Q_{FBZ}=Q_{FB}$ calculated on immediately preceding occasion the routine was executed, and Δl=increment.

An environment is thus obtained wherein the feedback correction amount $Q_{FB}$ calculated using equation (2) gradually varies, and hunting of the idle rotation speed does not easily occur. Under the usual control conditions, due to feedback control of the opening of the electronic throttle 14 based on the rotation speed deviation ΔNE of the internal combustion engine 11, the internal combustion engine 11 absorbs a certain amount of load fluctuation, and the real rotation speed is held near the target idle rotation speed.

The method of calculating the feedback correction amount $Q_{FB}$ in the step S202 is not limited to equation (2). It is sufficient to use a calculation method wherein the feedback correction amount $Q_{FB}$ varies gradually according to the deviation ΔNE on each occasion the routine is executed. For example, a calculation method of proportional/integral control wherein a proportional gain is set small, can also be applied to calculation of the feedback correction amount $Q_{FB}$ in the step S202.

In a next step S204, the controller 21 calculates an intake air flow rate increase amount ΔQN by looking up a map having the characteristics shown in the figure which is stored in the internal memory (ROM) based on the rotation speed deviation ΔNE.

Specifically, the intake air flow rate increase amount ΔQN increases as the rotation speed deviation ΔNE increases. When the rotation speed deviation ΔNE is smaller than a predetermined deviation W and the rotation speed deviation ΔNE is a negative value, the intake air flow increase amount ΔQN is zero. When ΔQN is zero, control of the intake air flow rate is performed depending on the feedback control based on the rotation speed deviation ΔNE in the step S202.

In a next step S205, it is determined whether or not the rotation speed deviation ΔNE of the controller 21 is equal to or greater than a predetermined value XNE. Here, the predetermined value XNE is set to zero. The predetermined value XNE is a value for determining whether the rotation speed NE of the internal combustion engine 11 has substantially returned to the target idle rotation speed tNE. It is not necessarily zero, and may be a value close to zero.

When the determination of the step S205 is affirmative, in a step S206, the controller 21 sets a final increase amount $\Delta QN_{MAX}$ of the intake air flow rate. Specifically, the larger of the intake air flow increase amount ΔQN found by looking up a map in the step S204 and an immediately preceding value $\Delta QN_{MAXZ}$ of the final increase amount $\Delta QN_{MAX}$ found on the immediately preceding occasion the routine was executed, is taken as the final increase amount $\Delta QN_{MAX}$.

When the rotation speed deviation ΔNE is equal to or greater than the predetermined value XNE in the step S205, and the rotation speed deviation ΔNE increases on each occasion the routine is executed, therefore, the intake air flow increase amount ΔQN found from the map in the step S204 is applied to the final increase amount $\Delta QN_{MAX}$ of the intake air flow rate.

On the other hand, in the step S205, when the rotation speed deviation ΔNE is equal to or greater than the predetermined value XNE, but the rotation speed deviation ΔNE decreases on each occasion the routine is executed, the immediately preceding value $\Delta QN_{MAXZ}$ is always applied to the final increase amount $\Delta QN_{MAX}$ of the intake air flow. In other words, the final increase amount $\Delta QN_{MAX}$ is held at a fixed value.

In a next step S207, the controller 21 calculates a total intake air flow rate $Q_{TOTAL}$ supplied to the internal combustion engine 11 by the following equation (3):

$$Q_{TOTAL}=Q_{CAL}+Q_{FB}+\Delta QN_{MAX} \quad (3)$$

where, $Q_{CAL}$=basic intake air flow rate during idle running of the internal combustion engine 11, and $Q_{FB}$=feedback correction amount of the intake air flow rate calculated in the step S201.

The basic intake air flow rate $Q_{CAL}$ is set beforehand according to the cooling water temperature of the internal combustion engine 11, and the running state of accessories such as the air conditioner.

When the determination of the step S205 is negative, i.e., when the rotation speed NE of the internal combustion engine 11 has reached or exceeded the target idle rotation speed tNE, the controller 21, in a step S208, sets the sum of the immediately preceding value $Q_{FBZ}$ of the feedback correction amount of intake air flow rate and the immediately preceding value $\Delta QN_{MAXZ}$, to the feedback correction amount $Q_{FB}$ of the intake air flow rate.

Here, the immediately preceding values mean $Q_{FB}$ calculated in the step S201 and the final increase amount $\Delta QN_{MAX}$ calculated in the step S206 on the immediately preceding occasion the routine was executed. An immediately preceding value $\Delta QN_{MAXZ}$ of the final increase amount corresponds to an increase correction amount when termination conditions are satisfied in the claims.

The controller 21 further sets the final increase amount $\Delta QN_{MAX}$ to zero. By setting the final increase amount $\Delta QN_{MAX}$ to zero, the value of $\Delta QN_{MAX}$ used for the calculation performed in the following step S207, is zero.

The reason why $\Delta QN_{MAX}$ is reset to zero in the step S208 is as follows. In the step S208, the feedback correction amount $Q_{FB}$ is calculated by adding the immediately preceding value $\Delta QN_{MAXZ}$ of the final increase amount, to the immediately preceding value $Q_{FBZ}$ of the feedback correction amount.

This feedback correction amount $Q_{FB}$ which was increased by the final increase amount $\Delta QN_{MAXZ}$ is used as the immediately preceding value $Q_{FBZ}$ on the next occasion the step S208 is executed. In other words, the immediately preceding value $Q_{FBZ}$ used on the next occasion the step S208 is executed, is a value which has already been increase-corrected. Therefore, on the next and subsequent occasions the step S208 is executed, $\Delta QN_{MAX}$ is reset to zero so that the increase correction is not duplicated.

After the processing of the step S206, the controller 21 performs the processing of the aforesaid step S207, and determines the total intake air flow rate $Q_{TOTAL}$. When the processing of the step S207 is performed following the step S205, $\Delta QN_{MAX}$ in equation (3) is zero.

After the processing of the step S207, the controller 21 terminates the routine.

The controller 21 regulates the opening of the electronic throttle 14 based on the total intake air flow $Q_{TOTAL}$ determined in this way.

Next, referring to FIGS. 3A–3E, the function of the above routine when there is a load change of the internal combustion engine, will be described. The solid line in the figure shows the result of executing the routine of FIG. 2. The dashed line in the figure shows the result of controlling the intake air flow rate only by feedback control according to equation (1).

Figures 3A, 3B, 3C, 3D, 3E:
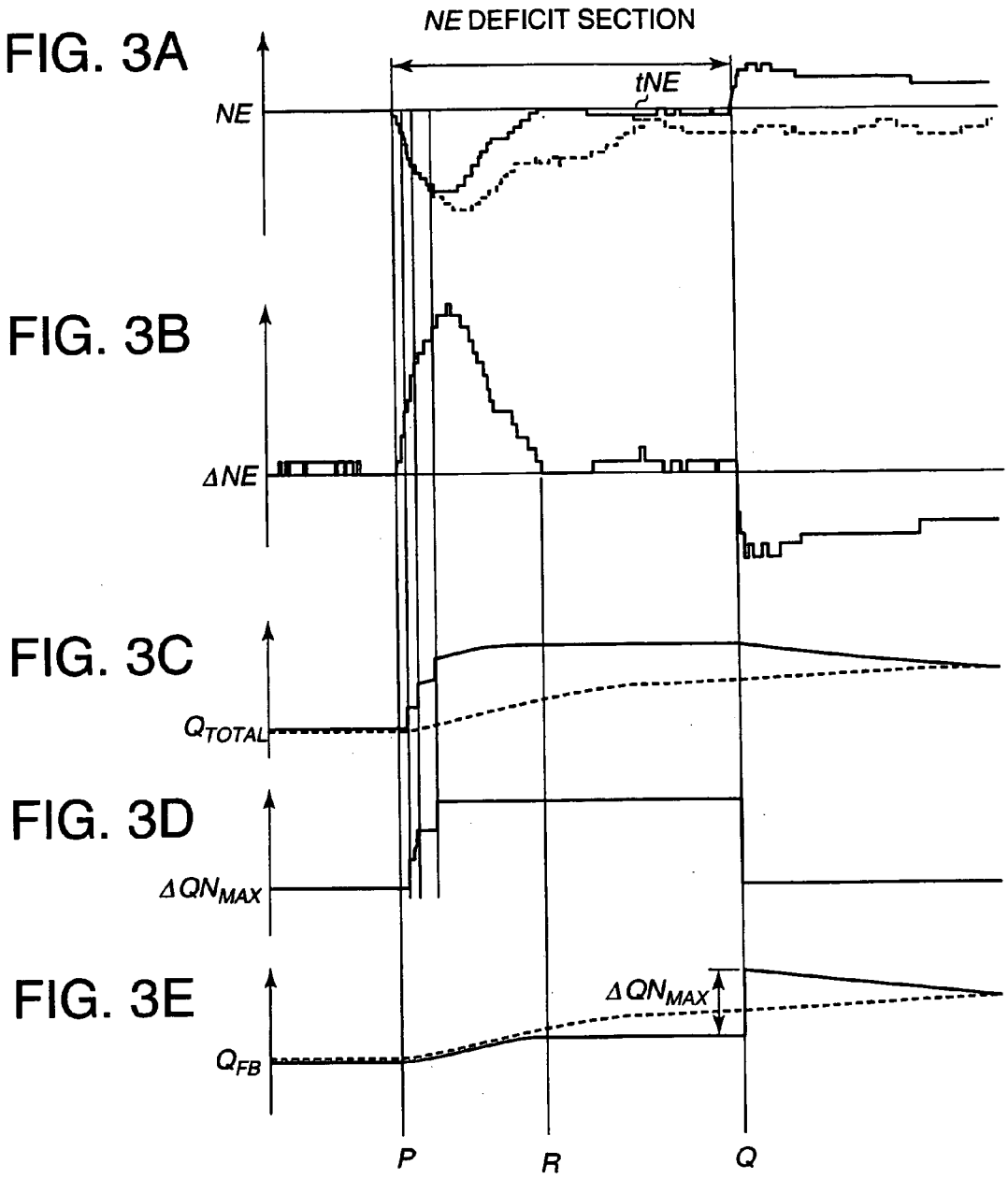
FIGS. 3A–3E are timing charts describing the execution result of the intake air flow rate correction routine.

Referring to FIG. 3A, if an unexpected load change occurs at a time P during idle running of the internal combustion engine 11, the rotation speed NE of the internal combustion engine 11 will drop sharply. If the rotation speed NE of the internal combustion engine 11 drops sharply, and only the general feedback control represented by equation (1) is performed, a long time is required for the rotation speed NE to return to the target idle rotation speed tNE, as shown in FIG. 3A. This is because, as shown in FIGS. 3C, 3D, in feedback control, the intake air flow rate increases only by Δl each time control is performed.

Figure 2:
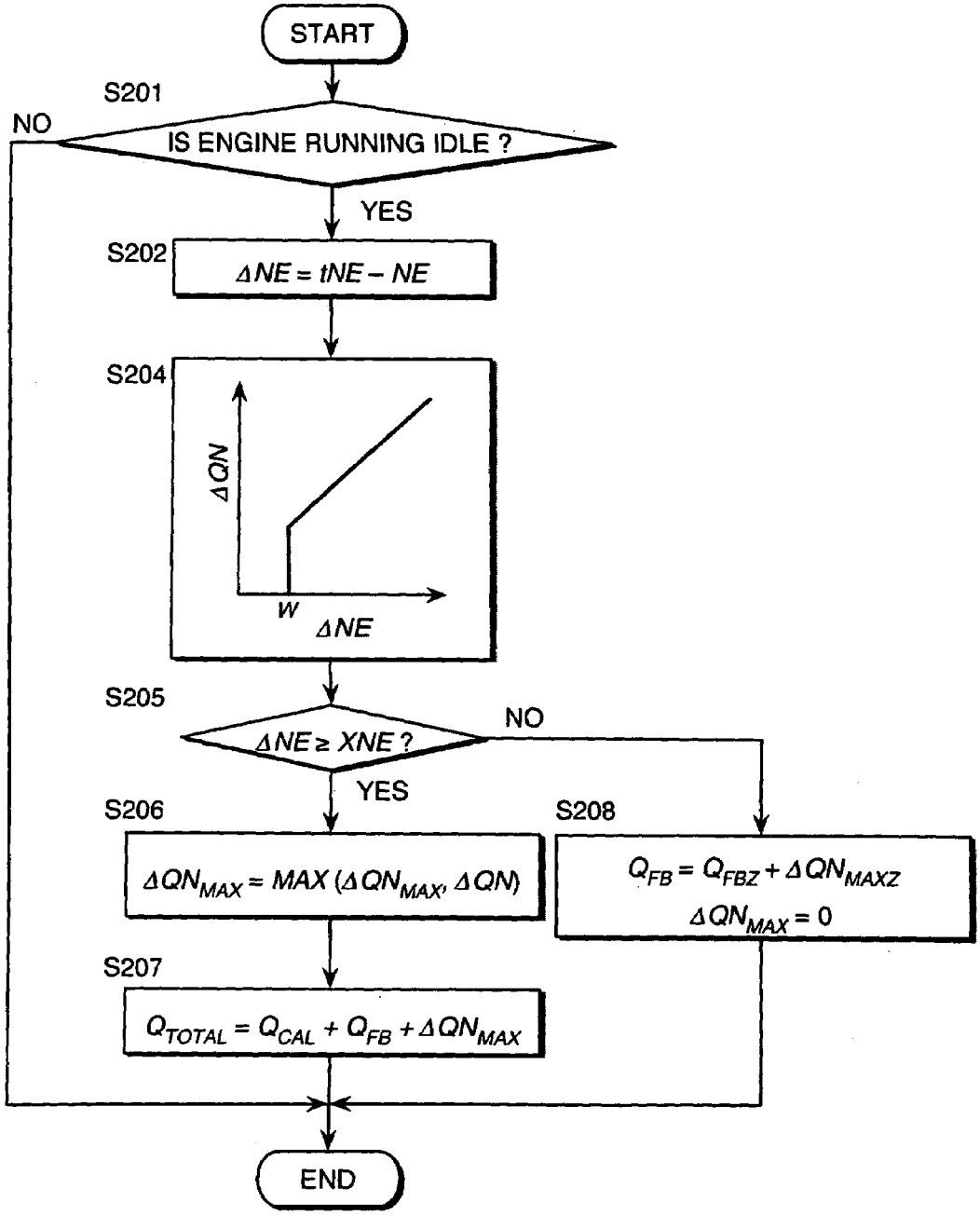
FIG. 2 is a flowchart describing an intake air flow rate correction routine performed by a controller according to this invention.

Conversely, if the intake air flow rate correction routine of FIG. 2 is performed, at and after the time P, until the rotation speed NE of the internal combustion engine 11 completely returns to the target idle rotation speed tNE, the feedback correction amount $Q_{FB}$ of the intake air flow rate is increased in the step S207 using the final increase amount $\Delta QN_{MAX}$ of the intake air flow rate calculated in the step S206.

Therefore, immediately after the time P when a decrease of the rotation speed of the internal combustion engine 11 is detected, the total intake air flow $Q_{TOTAL}$ increases considerably as shown in FIG. 3C, and the rotation speed NE rapidly approaches the target value tNE as shown in FIGS. 3A, 3B.

As a result of this control, at a time R shown in FIG. 3B, the rotation speed deviation ΔNE is already effectively zero. However, since the rotation speed deviation ΔNE has not become a negative value, in this step, the determination result of the step S205 of the routine of FIG. 2 is still affirmative. Therefore, as shown in FIGS. 3C,3D, both the final increase amount $\Delta QN_{MAX}$ of the intake air flow rate and the total intake air flow rate $Q_{TOTAL}$ are held at a high level.

When a time Q is reached, as shown in FIG. 3B, the rotation speed deviation ΔNE becomes a negative value, and the determination of the step S205 changes over to negative.

As a result, in the step S208, the final increase amount $\Delta QN_{MAX}$ is reset to zero, and on the next and subsequent occasions the routine is executed, only the feedback correction amount $Q_{FB}$ is applied to the total intake air flow rate $Q_{TOTAL}$.

In other words, the control returns to ordinary feedback control by integral control of the intake air flow rate. However, the immediately preceding value $Q_{FBZ}$ of the feedback correction amount applied in the step S208 on the next occasion the routine is executed, is a value to which an increase correction has been added as described above.

Summarizing this control, after the feedback correction amount $Q_{FB}$ of the intake air flow rate is increased by a value corresponding to the final increase amount $\Delta QN_{MAXZ}$ at the time Q, it gradually increases in increments of Δl in equation (2).

As described above, due to the execution of the routine of FIG. 2, even if the rotation speed NE of the internal combustion engine 11 drops sharply during idle running due to a large load fluctuation, the rotation speed NE can be rapidly returned to the target value tNE.

Also, as shown in FIG. 3B, as a result of the increase correction, the rotation speed NE has already returned to the vicinity of the target idle rotation speed tNE at a time R well before the time Q. However, in the routine of FIG. 2, the increase correction by the final increase amount $\Delta QN_{MAXZ}$ is not immediately stopped at the time R, and the increase correction is continued as shown in FIGS. 3C,3D until the deviation ΔNE becomes a negative value at the time Q.

Therefore, the rotation speed NE, which has returned to the vicinity of the target idle rotation speed tNE, is definitively prevented from dropping again due to interruption of the increase correction, and stable control of the intake air flow rate is achieved.

If it were desired to accelerate the response with which the rotation speed NE of the internal combustion engine 11, which has dropped during idle running, returns to the target idle rotation speed tNE, it would be sufficient to apply proportional/integral control to the feedback control of intake air flow rate, and set the proportional gain large.

However, if this control is applied after the rotation speed NE returns to the vicinity of the target idle rotation speed tNE at the time R in FIG. 3C, the proportional amount is zero or a value close to zero, so this has no effect in suppressing another drop of the rotation speed NE, and the control of the idle rotation speed is not stable.

According to this invention, by combining high stability integral control or a similar control with an increase correction of the intake air flow rate corresponding to a sharp drop of the rotation speed NE of the internal combustion engine 11, the rotation speed NE of the internal combustion engine 11 which has dropped sharply is rapidly returned to the target idle rotation speed tNE, and the engine rotation speed NE after it has returned, is stabilized.

In the above embodiment, in the calculation of the step S204, the intake air flow rate increase ΔQN is set to be zero until the rotation speed deviation ΔNE reaches a predetermined deviation W. Also, the predetermined value XNE used in the step S295 is set to zero.

However, various variations are possible regarding the setting of the predetermined deviation Wand the value of the predetermined value XNE.

Referring to FIGS. 4A–4E, a second embodiment of this invention will now be described wherein the predetermined deviation W is set to zero, and the predetermined value XNE is set to a positive value. The steps of the intake air flow rate correction routine performed by the controller 21 are identical to those of the first embodiment.

According to this embodiment, when the rotation speed deviation ΔNE is equal to or greater than the predetermined value XNE in the step S205, in the step S206, an increase correction of the intake air flow rate by the final increase amount $\Delta QN_{MAX}$ of the intake air flow rate, is applied.

Further, if the rotation speed deviation ΔNE falls below the predetermined value XNE at the time R in FIG. 4B, the increase correction of the intake air flow rate by the final increase amount $\Delta QN_{MAX}$ is immediately terminated, and subsequent control of the intake air flow rate is performed by the usual feedback control.

Figures 4A, 4B, 4C, 4D, 4E:
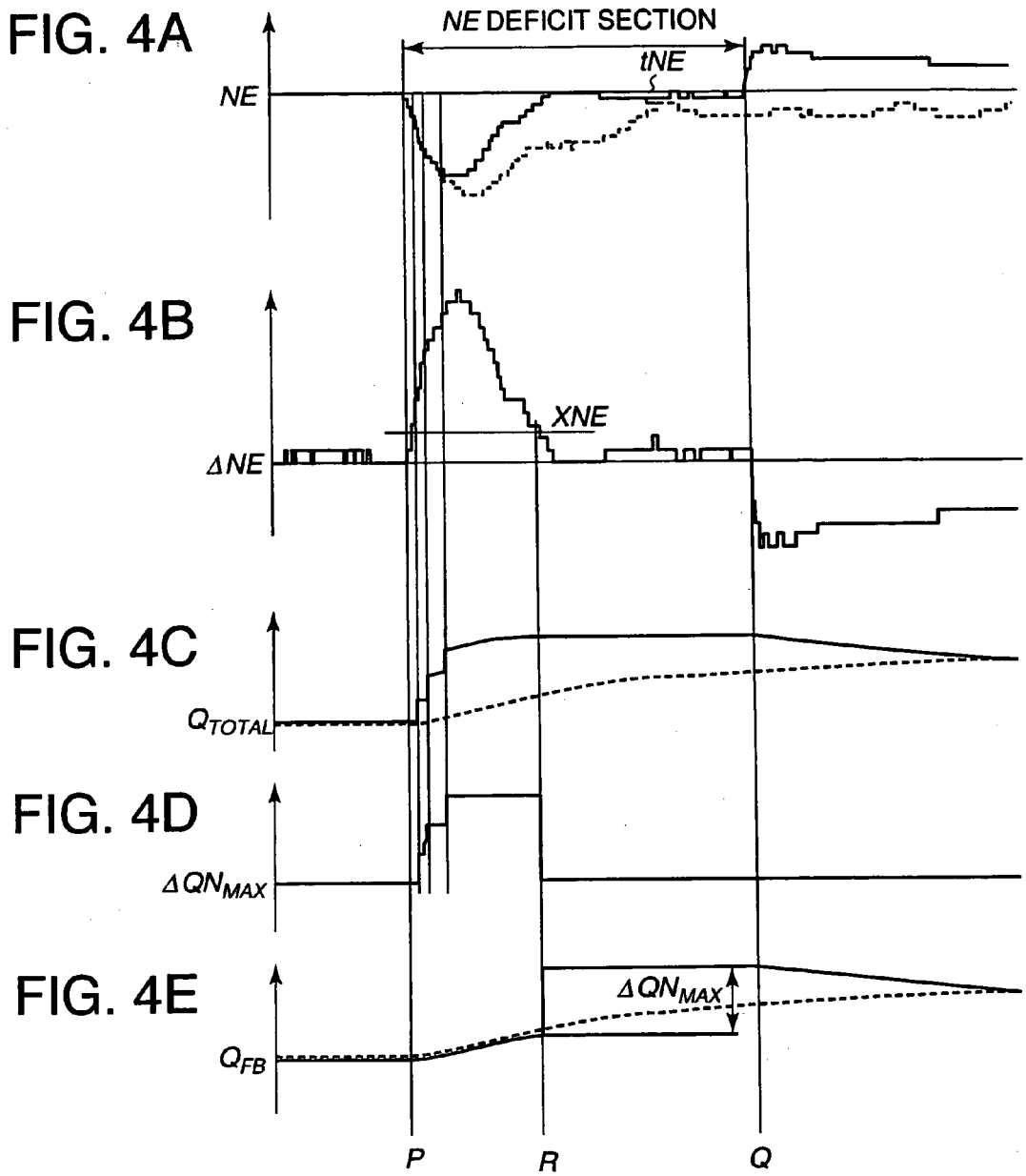
FIGS. 4A–4E are similar to FIGS. 3A–3E, but showing the execution result of a routine according to a second embodiment of the invention.

However, in the step S208, by incorporating the final increase amount $\Delta QN_{MAX}$ in the feedback correction amount $Q_{FB}$ as shown in FIG. 4E, the feedback correction amount $Q_{FB}$ is largely increased. As a result, the feedback correction amount $Q_{FB}$ is held at a high level until the rotation speed deviation ΔNE fluctuates largely in a negative direction at the time Q, i.e., until the rotation speed NE of the internal combustion engine 11 largely exceeds the target idle rotation speed tNE.

According to this embodiment, the increase correction of the intake air flow rate by the final increase amount $\Delta QN_{MAX}$ is terminated at the time R, but the final increase amount $\Delta QN_{MAX}$ of the time of termination is incorporated into the feedback correction amount $Q_{FB}$, so the increase correction of the intake air flow rate actually continues until a time T.

Therefore, as in the first embodiment, even if the rotation speed NE of the internal combustion engine 11 drops sharply during idle running due to a large load fluctuation, the rotation speed NE can be rapidly and surely returned to the target value tNE, and drop of the rotation speed NE after return is also prevented.

In this embodiment, the predetermined deviation W is set to zero, so there is no dead zone in the calculation of the intake air flow increase amount ΔQN. However, the predetermined value XNE is set to a positive value, so an identical result to that of the first embodiment is obtained regarding the control characteristics of the intake air flow rate.

Next, a third embodiment of this invention will be described referring to FIG. 5, and FIGS. 6A–6C.

Figure 5:
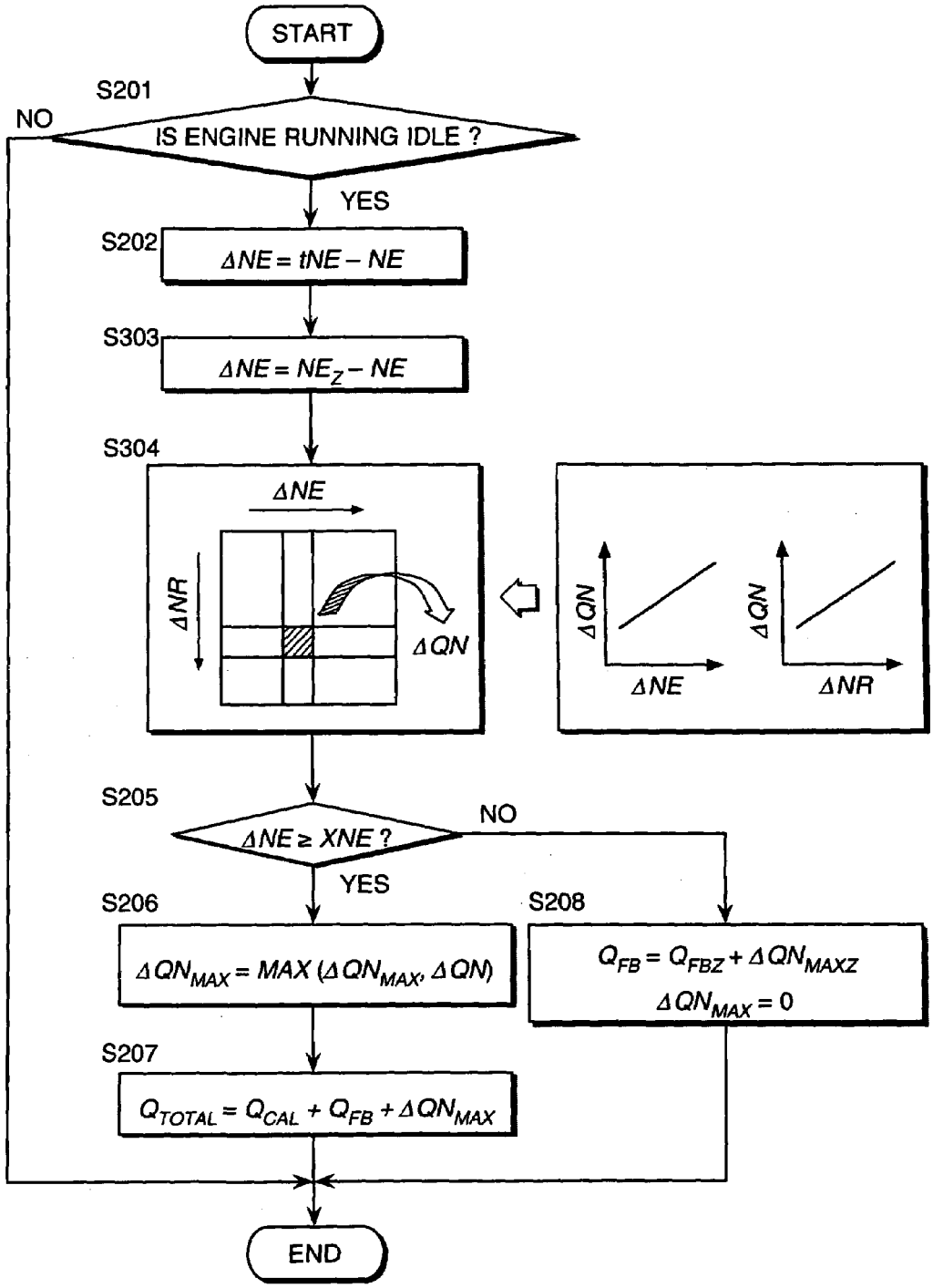
FIG. 5 is similar to FIG. 2, but showing a third embodiment of the invention.

In this embodiment, the controller 21 executes the intake air flow rate correction routine shown in FIG. 5 instead of the routine of FIG. 2 of the first embodiment.

In this routine, steps S303, S304 are provided instead of the step S204 of the routine of FIG. 2. The remaining steps are identical to those of the routine of FIG. 2. The controller 21 executes this routine at an interval of ten milliseconds during running of the internal combustion engine 11.

In the step S303, the controller 21 calculates a decrease ratio ΔNR of the rotation speed NE of the internal combustion engine 11 by the following equation (4):

$$\Delta NR = NE_Z - NE \tag{4}$$

where, $NE_Z$=immediately preceding value of the rotation speed NE of the internal combustion engine 11.

The routine is executed at an interval of ten milliseconds, so the decrease ratio ΔNR obtained in equation (4) corresponds to the variation of the rotation speed NE every ten milliseconds.

The controller 21, in the next step S304, calculates an intake air flow rate correction amount ΔQR by looking up a map stored beforehand in the memory (ROM) from the rotation speed deviation ΔNE and the rotation speed decrease ratio ΔNR.

Here, the characteristics of this map will be described. As shown by the diagram on the right of the step S304, the intake air flow rate correction amount ΔQR increases the larger the rotation speed deviation ΔNE is, or the larger the rotation speed decrease ratio ΔNR is.

This map is set by experimentally determining the increase amount of the intake air flow rate required to compensate the decrease of torque due to a given variation of rotation speed, and by considering the increase amount as the intake air flow rate correction amount ΔQR.

Except for the value of the predetermined value XNE, the remaining steps of the routine are identical to those of the routine of FIG. 2. In the first embodiment, the predetermined value XNE for determining whether or not the engine rotation speed NE has returned to the target idle rotation speed tNE was set to zero, but in this embodiment, the predetermined value is set to a positive value as in the second embodiment.

The difference between this embodiment and the second embodiment is therefore that the calculation of the intake air flow rate correction amount ΔQR depends on the rotation speed decrease ratio ΔNR in addition to the rotation speed deviation ΔNE. In other words, even if the rotation speed deviation ΔNE is identical to the second embodiment, if the rotation speed decrease ratio ΔNR is large, the intake air flow rate correction amount ΔQR calculated in the step S304 is a larger value than in the second embodiment.

Figure 6A:
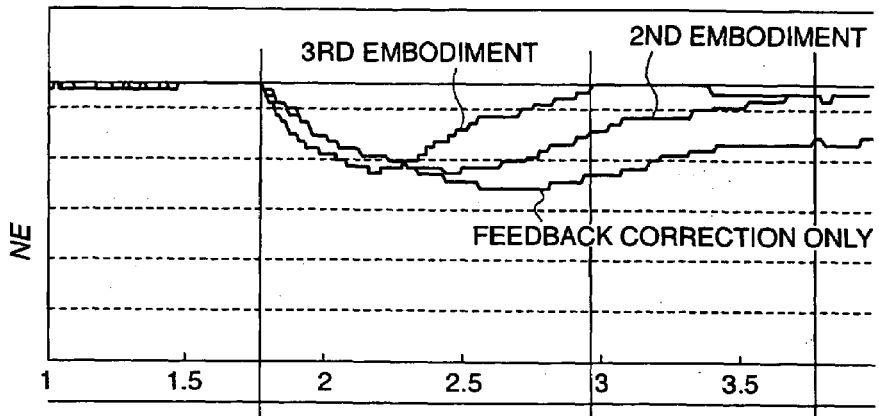
FIGS. 6A–6C are timing charts comparing the execution result of the intake air flow rate correction routine according to the third embodiment, with the execution result of the intake air flow rate correction routine according to the second embodiment.
Figure 6B:
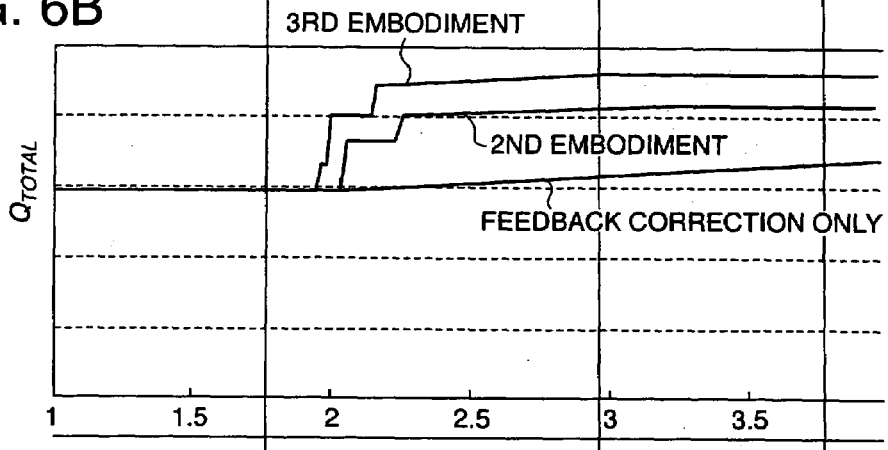
Figure 6C:
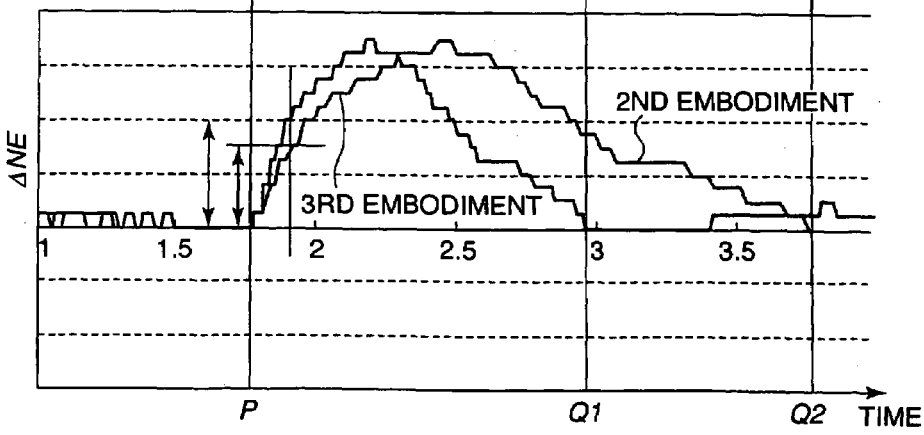

As a result, as shown in FIGS. 6A–6C, compared to the second embodiment, the time required to return the rotation speed NE of the internal combustion engine 11 which has dropped sharply, to the idle target rotation speed tNE, can be largely shortened. At the same time, regarding the rotation speed NE after it has returned to the target idle rotation speed tNE, a desirable stability can be maintained as in the second embodiment.

The contents of Tokugan 2004-153012, with a filing date of May 24, 2004 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, in the first and second embodiments, the intake air flow increase amount ΔQN is calculated from the deviation ΔNE of the engine rotation speed NE. In the third embodiment, the intake air flow increase amount ΔQN is calculated using both the deviation ΔNE and decrease ratio ΔNR. However, the intake air flow increase amount ΔQN can also be calculated based only on the decrease ratio ΔNR of the engine rotation speed NE.

The embodiments of this invention in which an exclusive property or privilege is claimed are defined as follows:

What is claimed is:

1. An idle rotation speed control device of an internal combustion engine, comprising:

a mechanism which regulates an intake air flow rate of the internal combustion engine;

a sensor which detects an engine rotation speed of the internal combustion engine; and a programmable controller programmed to:

calculate, when the engine rotation speed is different from an target idle engine rotation speed, a feedback correction amount so that the intake air flow rate is gradually varied in a direction such that the engine rotation speed approaches the target idle engine rotation speed;

calculate an increase correction amount of the intake air flow rate based on the engine rotation speed;

control, when the engine rotation speed drops below the target idle rotation speed, the mechanism based on the sum of the feedback correction amount and increase correction amount;

determine whether or not the engine rotation speed satisfies a preset increase correction termination condition; and set, when the engine rotation speed satisfies the increase correction termination condition, the sum of the feedback correction amount and increase correction amount when the termination condition is satisfied, to a new feedback correction amount, while setting the increase correction amount for subsequent control to be zero.

2. The control device as defined in claim 1, wherein the controller is further programmed to increase the increase correction amount, as the deviation between the engine rotation speed and the target idle rotation speed increases.

3. The control device as defined in claim 2, wherein the controller is further programmed, when the deviation of the engine rotation speed from the target idle rotation speed is less than a predetermined deviation, to set the increase correction amount to zero.

4. The control device as defined in claim 1, wherein the controller is further programmed to increase the increase correction amount, as a decrease ratio of the engine rotation speed increases.

5. The control device as defined in claim 1, wherein the controller is further programmed to repeatedly calculate the increase correction amount at a predetermined interval, and control the mechanism based on the sum of the larger of the increase correction amount calculated based on the engine rotation speed and the increase correction amount calculated on the immediately preceding occasion, and the feedback correction amount.

6. The control device as defined claim 1, wherein the controller is further programmed, when the engine rotation speed exceeds the target idle rotation speed, to determine that the engine rotation speed has satisfied the increase correction termination condition.

7. The control device as defined in claim 1, wherein the controller is further programmed not to control the mechanism based on the sum of the feedback correction amount and increase correction amount until the deviation between the engine rotation speed and target idle rotation speed is equal to or greater than a positive predetermined value.

8. The control device as defined in claim 1, wherein the controller is further programmed, when the deviation between the engine rotation speed and target idle rotation speed is less than a positive predetermined value, to determine that the engine rotation speed has satisfied the increase correction termination condition.

9. The control device as defined in claim 1, wherein the controller is further programmed to repeatedly calculate the feedback correction amount at a predetermined interval, and calculate the present feedback correction amount by adding a positive or negative fixed amount to the feedback correction amount calculated on the immediately preceding occasion.

10. An idle rotation speed control device of an internal combustion engine, comprising:

means for regulating an intake air flow rate of the internal combustion engine;

means for detecting an engine rotation speed of the internal combustion engine;

means for calculating, when the engine rotation speed is different from an target idle engine rotation speed, a feedback correction amount so that the intake air flow rate is gradually varied in a direction such that the engine rotation speed approaches the target idle engine rotation speed;

means for calculating an increase correction amount of the intake air flow rate based on the engine rotation speed;

means for controlling, when the engine rotation speed drops below the target idle rotation speed, the intake air flow rate regulating means based on the sum of the feedback correction amount and increase correction amount;

means for determining whether or not the engine rotation speed satisfies a preset increase correction termination condition; and means for setting, when the engine rotation speed satisfies the increase correction termination condition, the sum of the feedback correction amount and increase correction amount when the termination condition is satisfied, to a new feedback correction amount, while setting the increase correction amount for subsequent control to be zero.

11. An idle rotation speed control method of an internal combustion engine, the engine comprising a mechanism which regulates an intake air flow rate, the control method comprising:

detecting an engine rotation speed of the internal combustion engine;

calculating, when the engine rotation speed is different from an target idle engine rotation speed, a feedback correction amount so that the intake air flow rate is gradually varied in a direction such that the engine rotation speed approaches the target idle engine rotation speed;

calculating an increase correction amount of the intake air flow rate based on the engine rotation speed;

controlling, when the engine rotation speed drops below the target idle rotation speed, the mechanism based on the sum of the feedback correction amount and increase correction amount;

determining whether or not the engine rotation speed satisfies a preset increase correction termination condition; and setting, when the engine rotation speed satisfies the increase correction termination condition, the sum of the feedback correction amount and increase correction amount when the termination condition is satisfied, to a new feedback correction amount, while setting the increase correction amount for subsequent control to be zero.

* * * * *